US009566492B1

(12) United States Patent
Dunning

(10) Patent No.: US 9,566,492 B1
(45) Date of Patent: Feb. 14, 2017

(54) APPARATUS FOR TEACHING TACKLING TECHNIQUE

(71) Applicant: David Dunning, Brentwood, CA (US)

(72) Inventor: David Dunning, Brentwood, CA (US)

( * ) Notice: Subject to any disclaimer, the term of this patent is extended or adjusted under 35 U.S.C. 154(b) by 0 days.

(21) Appl. No.: 15/082,616

(22) Filed: Mar. 28, 2016

(51) Int. Cl.
*A63B 69/34* (2006.01)
*A63B 69/00* (2006.01)
*A63B 69/38* (2006.01)

(52) U.S. Cl.
CPC ..... *A63B 69/345* (2013.01); *A63B 69/00* (2013.01); *A63B 69/0002* (2013.01); *A63B 69/38* (2013.01)

(58) Field of Classification Search
CPC ... A63B 69/345; A63B 69/00; A63B 69/0002; A63B 69/38
USPC ..... 473/445, 422, 438–444; 482/142, 93–95, 482/90; D21/788, 791, 767, 698
See application file for complete search history.

(56) References Cited

U.S. PATENT DOCUMENTS 2,620,188 A 12/1952 Malagio
2,934,343 A * 4/1960 Schumacher ..... A63B 69/345 473/445
3,416,795 A 12/1968 Lewis et al.
3,907,291 A * 9/1975 Parker ..... A63B 69/345 473/445
5,013,039 A * 5/1991 Cole ..... A63B 69/345 473/445
5,474,290 A 12/1995 Rascona et al.
6,458,051 B1 * 10/2002 Moore ..... A63B 69/345 473/422
7,070,521 B2 7/2006 Bayduke
7,131,917 B2 11/2006 Spencer
7,147,579 B2 * 12/2006 Forrest ..... A63B 69/345 473/422
7,322,893 B2 1/2008 Bright
7,794,337 B2 * 9/2010 Gamboa ..... A63B 69/345 473/438
7,955,223 B1 * 6/2011 Gilman ..... A63B 69/345 482/142
7,972,224 B2 * 7/2011 Gilman ..... A63B 69/345 473/441
2012/0157244 A1 6/2012 Staten et al.
2012/0283047 A1 11/2012 Detroia
2013/0184104 A1 7/2013 Gilman

* cited by examiner

*Primary Examiner* — Mitra Aryanpour
(74) *Attorney, Agent, or Firm* — Thomas R. Lampe

(57) ABSTRACT

Apparatus for teaching proper tackling technique to a football player includes a number of framework segments pivotally connected at framework segment ends. A latch mechanism in the framework is disengaged during tackling to prevent pivoting between two of the framework segments until a third segment with a tackling pad pivots a predetermined degree.

12 Claims, 4 Drawing Sheets

APPARATUS FOR TEACHING TACKLING TECHNIQUE

TECHNICAL FIELD

This invention relates to athletic equipment and more particularly to apparatus for teaching proper tackling technique to a football player.

BACKGROUND OF THE INVENTION

The use of devices for teaching or training football players to tackle are known. Some of these devices are in the form of sleds pushed by a player or players along the ground while others utilize structural components that are fixed in place on the ground with certain other structural components thereof being movable during tackling training or practice.

The following prior art references are known and are believed to be representative of the current state of the art in this field: U.S. Pat. No. 7,322,893, issued Jan. 29, 2008, U.S. Pat. No. 7,131,917, issued Nov. 7, 2006, U.S. Pat. No. 7,070,521, issued Jul. 4, 2006, U.S. Pat. No. 5,474,290, issued Dec. 12, 1995, U.S. Pat. No. 3,416,795, issued Dec. 17, 1968, U.S. Pat. No. 2,20,188, issued Dec. 2, 1952, U.S. Patent App. Pub. No. US 2013/0184104, issued Jul. 18, 2013, U.S. Patent App. Pub. No. US 2012/0283047, issued Nov. 8, 2012, and U.S. Patent App. Pub. No. US 2012/0157244, issued Jun. 21, 2012.

DISCLOSURE OF INVENTION

The present invention relates to apparatus for teaching proper tackling technique to a football player and utilizes structural components of a novel character cooperating in a unique manner to teach proper tackling technique.

When making a proper fundamental tackle the tackler should approach the ball carrier in a good athletic position. Feet should be about shoulder width apart, the knees bent and a slight bend at the waist. This position will allow the tackler to keep head up to see the approaching runner and stay agile while making contact. At the point of impact the tackler should put his facemask into the ball or the solar plexus area while shooting his arms all the way around the ball carrier, wrapping arms around the low back and squeezing, while at the same time lifting slightly to take the ball carrier out of his power position of running. The tackler's legs should be outside the ball carrier's legs and the tackler should continue driving with his legs until he falls to the ground with ball carrier, thus completing a proper fundamental tackle. Doing a proper fundamental tackle will eliminate many injuries that occur during tackling and give longevity to players.

The apparatus of the present invention includes a ground engaging base structure. A framework is connected to and projects upwardly from the base structure.

The framework has a first framework segment attached to the base structure, extending from the base structure and having a distal end. A double-ended second framework segment of the apparatus has one end thereof pivotally connected to the distal end. A third framework segment is pivotally connected to the other end of the double-ended second framework segment. The third framework segment supports a tackling pad, which covers the framework frame from top down to an area of the base structure disposed at a 45 degree angle.

The apparatus also includes a pivot control mechanism operatively associated with the second framework segment and the third framework segment resisting pivotal movement of the third framework segment relative to the second framework segment caused by a tackling force applied to the tackling pad.

The apparatus includes a latch for preventing pivotal movement of the second framework segment relative to the first framework segment.

Latch release structure is incorporated in the invention for unlatching the latch and allowing pivoting of the second framework section only after a predetermined amount of pivotal movement of the first framework segment relative to the second framework segment has occurred.

Other features, advantages and objects of the present invention will become apparent with reference to the following description and accompanying drawings.

MODES FOR CARRYING OUT THE INVENTION

Figure 1:
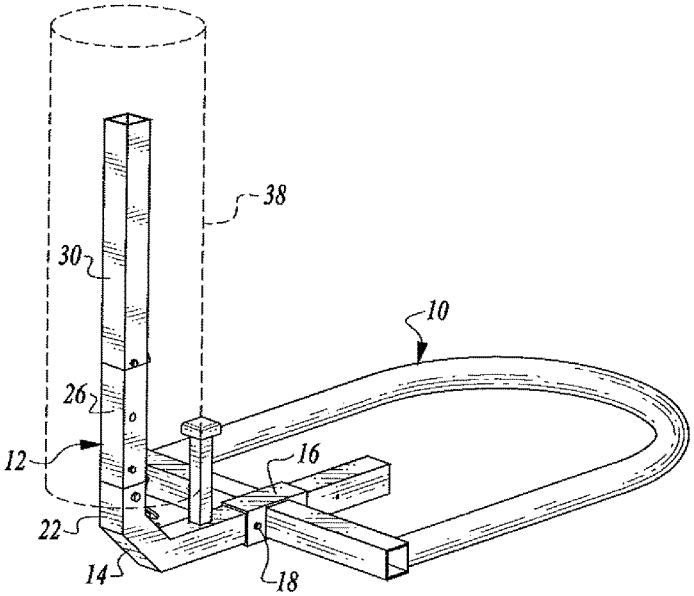
FIG. 1 is a frontal, perspective view of a preferred embodiment of the invention.
Figure 2:
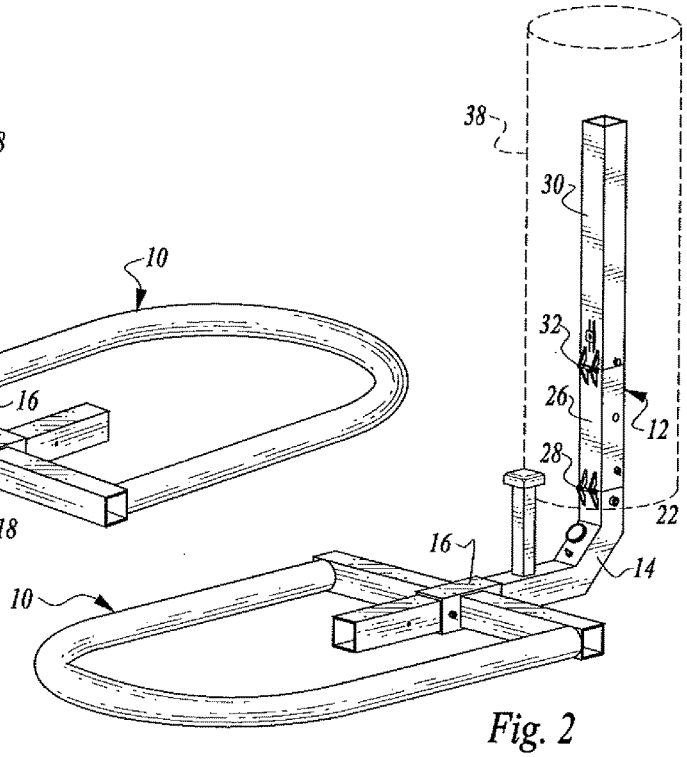
FIG. 2 is a rear, perspective view of the first embodiment.
Figure 3:
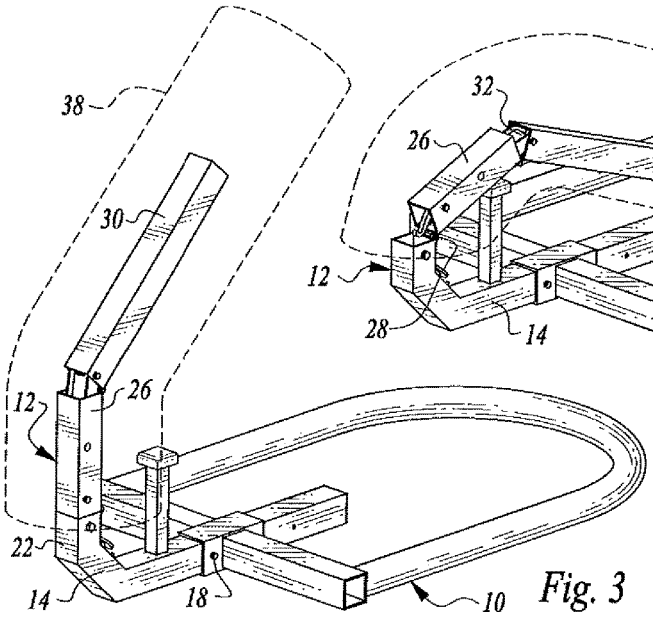
FIG. 3 is a view similar to FIG. 1 illustrating the third framework segment of the apparatus and tackling pad secured thereto pivoted relative to the second framework segment of the invention.
Figure 4:
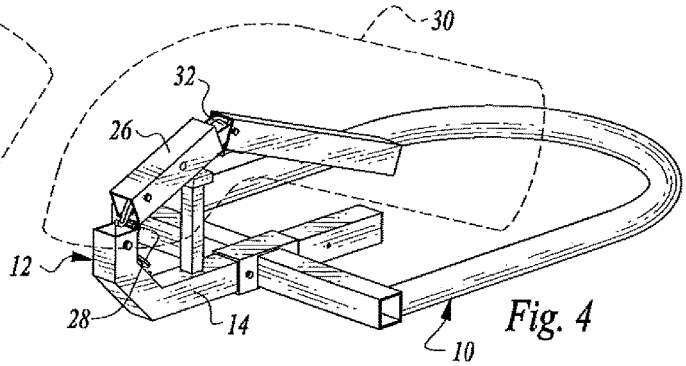
FIG. 4 is a view similar to FIG. 3, but illustrating the second framework segment pivoted relative to the first framework segment and listing one a stop support.

Referring now to FIGS. 1-13, a preferred embodiment of the present invention is illustrated. The invention is apparatus for teaching proper tackling technique to a football player. The apparatus can, of course, be utilized for general football tackling practice purposes.

The apparatus includes a ground engaging base structure 10. A framework 12 is connected to and projects upwardly from the base structure.

The framework has a first framework segment 14 attached to the base structure. In the arrangement illustrated, the first framework segment 14 is positioned in a housing 16 of the base structure. The positioning of the first framework segment relative to the housing can be varied and the first framework segment secured at the desired position relative to the base structure by a pin or bolt 18 alternatively positionable in holes 20 formed in the first framework segment. The first framework segment extends from the base structure and has a distal end 22.

The framework also includes a second framework segment 26 that is double-ended. One of the ends of the second framework segment is pivotally connected by pivot 28 to the distal end 22.

A third framework segment 30 is pivotally connected to the other end of the double-ended second framework segment by pivot 32. The third framework segment supports a tackling pad 38. The tackling pad covers the framework from top down to an area of the base structure disposed at a 45 degree angle.

The framework segments are all of rigid tubular construction and jointly define a hollow framework interior 40.

Disposed within the hollow framework interior is a pivot control mechanism operatively associated with the second framework segment and the third framework segment resisting pivotal movement of the third framework segment relative to the second framework segment caused by a tackling force applied to the tackling pad. More particularly, the pivot control mechanism includes an air cylinder 44 connected to the second framework segment at the air cylinder arm 46. The air cylinder is connected to third framework support 30 by a bracket 48. A pivot shaft or pin 50 pivotally connects the two arms 56 of the bracket to the lower end of third framework segment 30. The distal ends of the bracket arms 56 are tapered to provide upper bearing surfaces engageable by the third framework support 30 when pivoted in a manner to be described below to the position shown in FIG. 10.

Also disposed within the hollow framework interior 40 is a latch for preventing pivotal movement of the second framework segment relative to the first framework segment about pivot 28. More particularly, the latch includes a latch hook 60 pivotally mounted on a pin 62 extending between opposed sides of the second framework segment.

The latch hook is engageable with a rigid latch element in the form of a shaft 66 connected to the first framework segment 14.

Latch release structure is incorporated in the apparatus for unlatching the latch and allowing pivoting of the second framework segment only after a predetermined amount of pivotal movement of the third framework segment relative to the second framework segment has occurred. The latch release structure is a connector element extending between the latch hook and the third framework segment, pivoting of the third framework segment relative to the second framework segment causing movement of the connector element and unlatching of the latch hook from shaft 66. Preferably, the third framework segment tilts about 45 degrees before the latch is disengaged. The connector illustrated is a flexible, elongated member 70 which may suitably be a cable, wire or cord. A clamp 72 may suitably be employed to secure the two free ends of the doubled-over connector to third framework segment 30.

Figure 6:
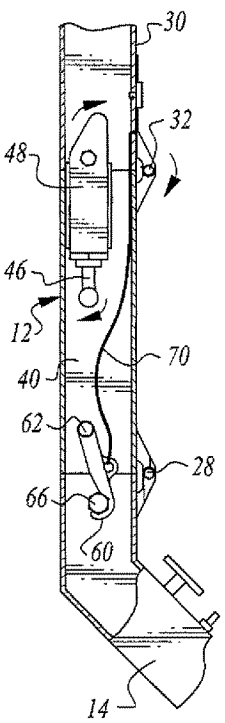
Figure 5:
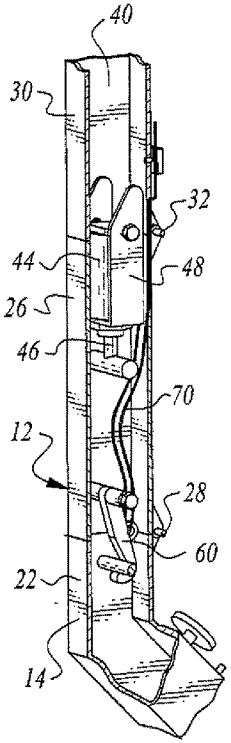
Figure 13:
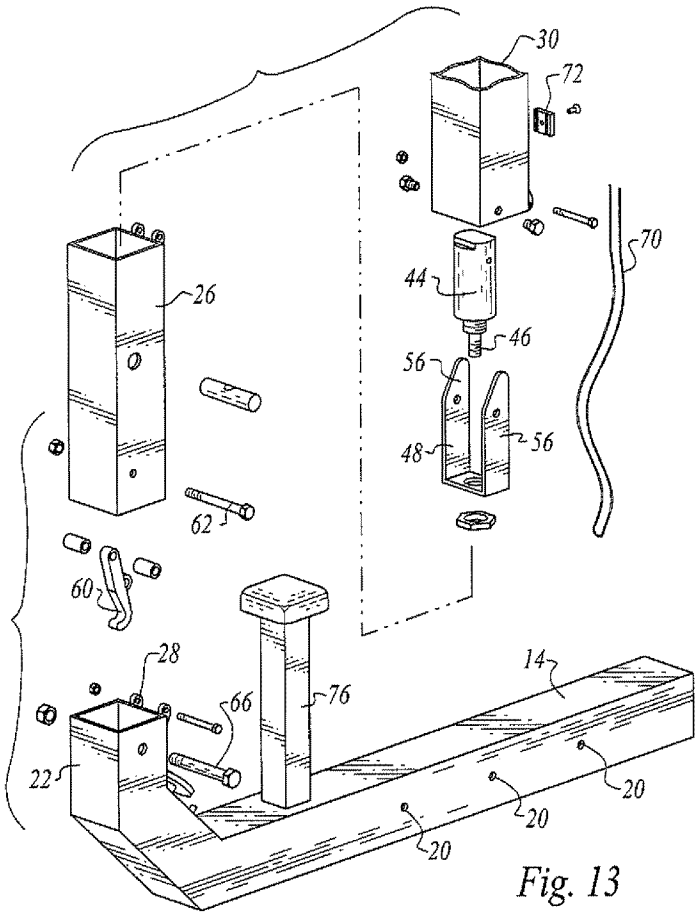
FIG. 13 is an exploded, perspective view illustrating structural components of the apparatus.

FIGS. 1, 2, 5 and 6 show the positions of the structural elements of the apparatus prior to use of the apparatus. FIG. 6 illustrates by means of arrows the pattern of motion of selected structural elements after a tackling force is initially applied. That is, the tackling force will tend to cause movement around pivot 32.

Figure 10:
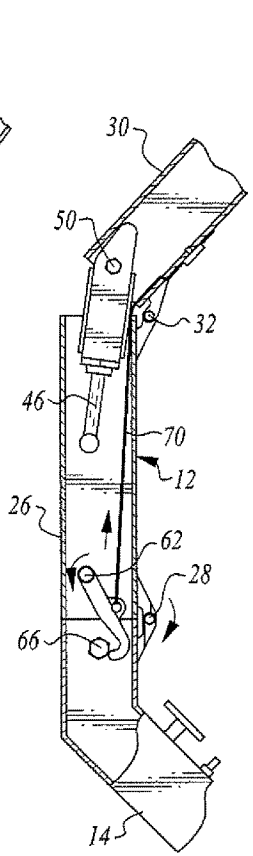
FIGS. 5-10 are cross-sectional partial views illustrating portions of the first and third framework sections and the entirety of the second framework segment along with a pivot control mechanism, a latch and latch release structure disposed within the interior of the framework in the positions assumed thereby during sequential stages of operation of the apparatus.
Figure 9:
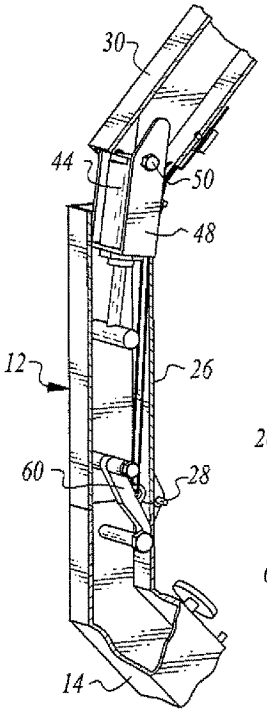
Figure 8:
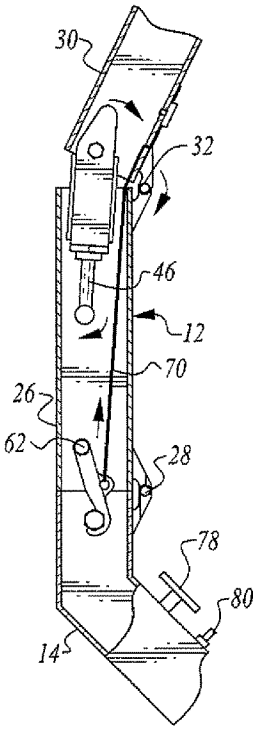
Figure 7:
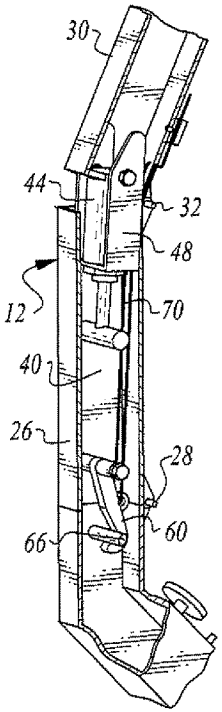

FIGS. 7 and 8 show the third framework segment 30 pivoted about pivot 32 when tackling forces being applied to the tackling pad. It will be noted that flexible member. 70 which heretofore had been untensioned becomes tensioned and exerts an upward pulling force on latch hook 60. Further pivotal movement of the third framework segment will, as shown in FIGS. 9 and 10, cause the latch hook to delatch from shaft 66.

Figure 11:
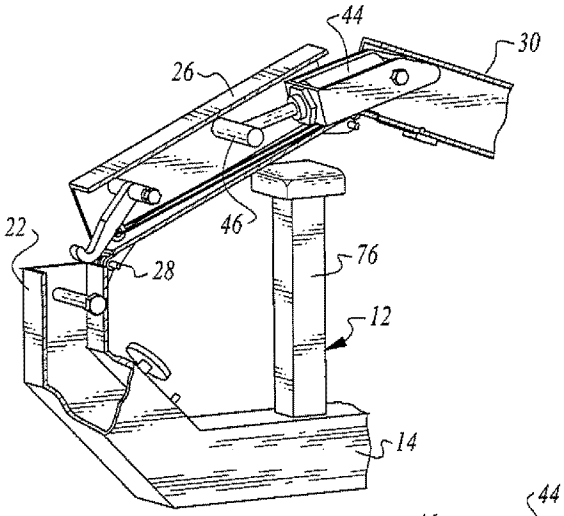
FIG. 11 is a perspective view of structural elements of the apparatus with the second framework segment engaging and supported by a stop support.
Figure 12:
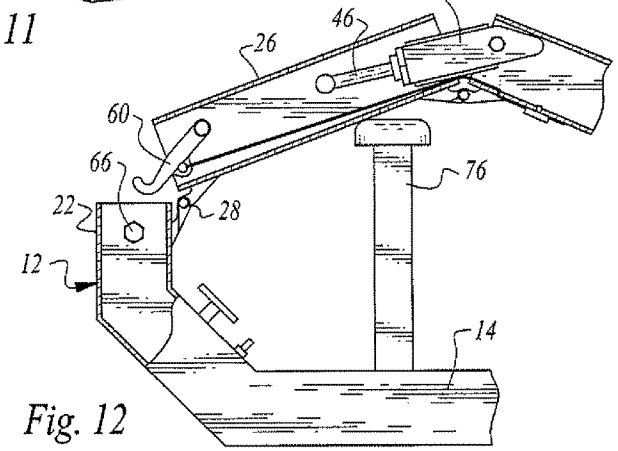
FIG. 12 is a side, elevational view illustrating the components shown in FIG. 11 in the positions assumed thereby in FIG. 11.

When this occurs, the second framework segment is free to pivot about pivot 28 and assume the position shown in FIGS. 11 and 12 wherein the third framework segment has engaged and rests on stop support 76 extending upwardly from the first framework segment to limit pivotal movement of the second framework segment relative to the first framework segment.

The preferred embodiment of the invention includes an air pressure gauge 78 for monitoring the air pressure of the air cylinder and a compressed air valve 80 for supplementing or relieving air in the air cylinder to change the air pressure in the air cylinder.

Figure 15:
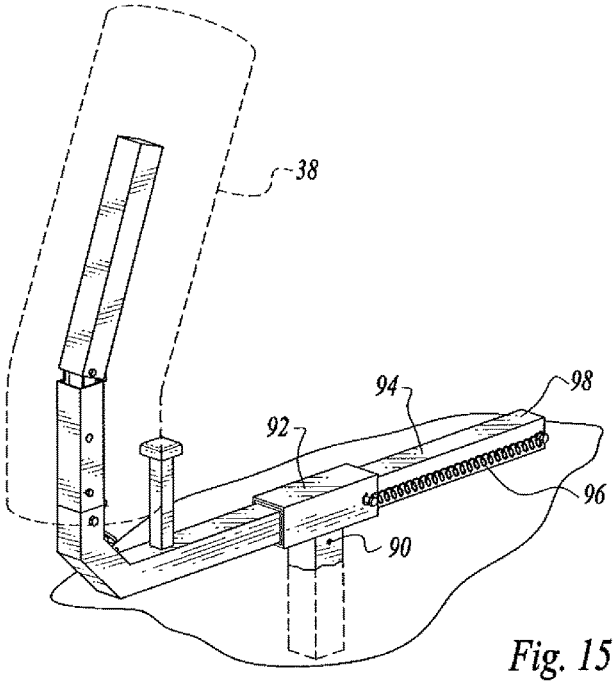
FIG. 15 is a perspective view of the second embodiment showing the second embodiment in a stage of operation wherein the third framework segment and support pad thereof are shown in a position when a tackling force is being applied to the support pad.
Figure 14:
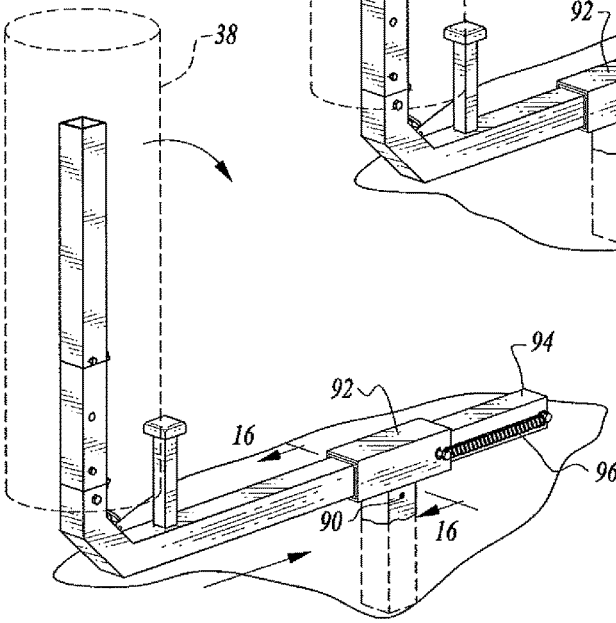
FIG. 14 is a view similar to FIG. 1, but illustrating a second embodiment of the invention.
Figure 16:
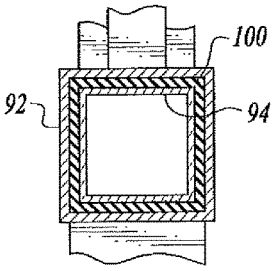
FIG. 16 is a greatly enlarged, cross-sectional view taken the line 16-16 of FIG. 14.

FIGS. 14-16 show an alternative embodiment of the invention which corresponds in virtually all respects to the embodiment depicted in FIGS. 1-13 except for the fact that the base structure is not a ground engaging slide, but rather includes a post 90 positioned in the ground and a housing 92 supported by the post and receiving first framework segment 94 which is longer than the first framework segment 14 of the first embodiment and has no holes formed therein. A tension spring 96 interconnects the housing 92 to the end 98 of the first framework segment 94 to maintain the position of the first framework segment as shown in FIG. 14. Tackling force applied to the tackling pad 38 will move the first framework segment to the right as shown in FIG. 15 against the urging of the spring biasing means. That is, the spring biases the framework in the direction opposed to the direction of tackling force applied to the blocking pad. A liner 100 of any suitable low friction material such as vinyl may be positioned within the housing to facilitate sliding and reduce wear.

The invention claimed is:

1. Apparatus for teaching tackling technique to a football player, said apparatus comprising, in combination:

a ground engaging base structure;

a framework connected to and projecting upwardly from said base structure, said framework having a first framework segment attached to said base structure, extending from said base structure and having a distal end, a double-ended second framework segment having one end thereof pivotally connected to said distal end, and a third framework segment pivotally connected to the other end of said double-ended second framework segment, said third framework segment supporting a tackling pad;

a pivot control mechanism operatively associated with said second framework segment and said third framework segment resisting pivotal movement of said third framework segment relative to said second framework segment caused by a tackling force applied to said tackling pad;

a latch for preventing pivotal movement of said second framework segment relative to said first framework segment; and latch release structure for unlatching said latch and allowing pivoting of said second framework segment only after a predetermined amount of pivotal movement of said first framework segment relative to said second framework segment has occurred.

2. The apparatus according to claim 1 wherein said ground engaging base structure is a ground supported slide attached to said first framework segment.

3. The apparatus according to claim 1 wherein said ground engaging base structure includes a post positioned in the ground and a housing supported by the post receiving said first framework segment.

4. The apparatus according to claim 1 wherein said framework segments are of rigid tubular construction and jointly define a hollow framework interior.

5. The apparatus according to claim 4 wherein said pivot control mechanism and said latch are located within said hollow framework interior.

6. The apparatus according to claim 1 wherein said pivot control mechanism includes an air cylinder connected to said second framework segment and said third framework segment.

7. The apparatus according to claim 1 wherein said latch includes a latch hook pivotally mounted on said second framework segment engageable with a rigid latch element connected to said first framework segment.

8. The apparatus according to claim 7 wherein said latch release structure is a connector element extending between said latch hook and said third framework segment, pivoting of said third framework segment relative to said second framework segment causing movement of said connector element and unlatching of said rigid latch element by said latch hook.

9. The apparatus according to claim 8 wherein said connector comprises a flexible cable, wire or cord.

10. The apparatus according to claim 6 additionally including an air pressure gauge for monitoring the air pressure in said air cylinder and an air valve for changing the air pressure in said air cylinder.

11. The apparatus according to claim 1 including a stop support extending upwardly from said first framework segment for engagement by said second framework segment to limit pivotal movement of said second framework segment relative to said first framework segment.

12. The apparatus according to claim 3 wherein said first framework segment is slidably mounted in said housing and wherein said apparatus additionally comprises biasing structure for biasing said framework in a direction opposed to the direction of tackling force applied to said tackling pad.

* * * * *